US010790586B2

(12) United States Patent
Klemes

(10) Patent No.: US 10,790,586 B2
(45) **Date of Patent: *Sep. 29, 2020**

(54) ADJUSTABLE STACKED PHASE-MODE FEED FOR 2D STEERING OF ANTENNA ARRAYS

(71) Applicant: HUAWEI TECHNOLOGIES CO., LTD., Shenzhen (CN)

(72) Inventor: Marek Klemes, Ottawa (CA)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 305 days.

This patent is subject to a terminal disclaimer.

(21) Appl. No.: 15/624,262

(22) Filed: Jun. 15, 2017

(65) Prior Publication Data

US 2018/0366825 A1 Dec. 20, 2018

(51) Int. Cl.
*H01Q 3/36* (2006.01)
*H01Q 3/44* (2006.01)
(Continued)

(52) U.S. Cl.
CPC ..... *H01Q 3/36* (2013.01); *H01Q 3/267* (2013.01); *H01Q 3/44* (2013.01);
(Continued)

(58) Field of Classification Search
CPC ..... H01Q 21/0012; H01Q 21/0031; H01Q 21/0068; H01Q 21/0056; H01Q 3/36
See application file for complete search history.

(56) References Cited

U.S. PATENT DOCUMENTS 3,022,506 A 2/1962 Goebels, Jr. et al.
3,827,055 A 7/1974 Bogner et al.
(Continued)

FOREIGN PATENT DOCUMENTS

CN 1390368 A 1/2003
CN 104821434 A 8/2015
(Continued)

OTHER PUBLICATIONS

J.G. Davis and A.A.P. Gibson: "Phase Mode Excitation in Beamforming Arrays", pp. 307-310, Proceedings of the 3rd European Radar Conference, Manchester, UK, Sep. 2006.
(Continued)

*Primary Examiner* — Gregory C. Issing

(57) ABSTRACT

A feed network, steering apparatus and system for a steerable antenna array are described. The feed network includes a waveguide assembly including first and second radial transverse electromagnetic (TEM) waveguides, and first and second variable phase shifters positioned in the respective TEM waveguides. The variable phase shifters cause additional progressive electrical phase shifts in respective rings of radiating elements, directly proportional to the angular position of the radiating elements in the ring, from 0 to a controllable integer multiple of 2π radians. The feed network includes first and second phase-mode feed probes coupled to the respective radial TEM waveguides, which provide respective phase-mode feed ports. When the feed network is coupled to the antenna array, two consecutive-order phase modes are provided at the phase-mode feed ports. The orders of the phase modes are selectable using a phase shift control signal controlling the integer multiple of the variable phase shifters.

15 Claims, 10 Drawing Sheets

(51) Int. Cl.
*H01Q 21/20* (2006.01)
*H01Q 21/00* (2006.01)
*H01Q 3/26* (2006.01)

(52) U.S. Cl.
CPC ..... *H01Q 21/0031* (2013.01); *H01Q 21/0037* (2013.01); *H01Q 21/20* (2013.01)

(56) References Cited

U.S. PATENT DOCUMENTS

| | | | | |
|---|---|---|---|---|
| 4,814,775 | A | 3/1989 | Raab | |
| 7,839,349 | B1 | 11/2010 | West | |
| 9,219,309 | B2 * | 12/2015 | Costas | H01Q 3/26 |
| 9,413,067 | B2 | 8/2016 | Klemes | |
| 9,595,766 | B2 * | 3/2017 | Ashrafi | H01Q 21/061 |
| 9,768,503 | B2 | 9/2017 | Klemes | |
| 10,148,009 | B2 | 12/2018 | Klemes | |
| 10,283,862 | B2 * | 5/2019 | Klemes | H01Q 3/40 |
| 2003/0052825 | A1 | 3/2003 | Rao et al. | |
| 2004/0090286 | A1 | 5/2004 | Runyon | |
| 2005/0017822 | A1 | 1/2005 | Runyon | |
| 2005/0259019 | A1 | 11/2005 | Miles | |
| 2007/0210976 | A1 | 9/2007 | Luk et al. | |
| 2014/0266901 | A1 | 9/2014 | Klemes | |
| 2015/0349422 | A1 | 12/2015 | Klemes | |
| 2016/0218429 | A1 | 7/2016 | Klemes | |
| 2016/0315386 | A1 | 10/2016 | Klemes | |
| 2017/0149134 | A1 * | 5/2017 | Klemes | H01Q 3/40 |

FOREIGN PATENT DOCUMENTS

| | | | |
|---|---|---|---|
| JP | H0629726 | A | 2/1994 |
| WO | 0103233 | A1 | 1/2001 |

OTHER PUBLICATIONS

N. Karavassilis, D.E.N. Davies, and C.G. Guy: "Experimental HF circular array with direction finding and null steering capabilities", IEE Proceedings, Part H, vol. 133, No. 2, Apr. 1986.

T. Rahim and D.E.N. Davies: "Effect of directional elements on the directional response of circular antenna arrays", IEE Proceedings, Part H, vol. 129, No. 1, Feb. 1982.

A. Akiyama, J. Hirokawa, M. Ando, E. Takeda, and Y. Arai: "Characteristics of 60GHz Band Conical Beam Radial Line Slot Antennas", IEEE International Symposium on Antennas and Propagation, pp. 2122-2125, 1999.

A. Sibille, C. Roblin, and G. Poncelet: "Beam Steering Circular Monopole Arrays for Wireless Applications", IEE International Conference on Antennas and Propagation, vol. 1, 14-17, Apr. 1997, pp. 358-361.

Mandieh B. Shemirani and Farshid Aryanfar: "Analog implementation of high resolution DFT in RF domain, utilizing a special multilayer realization of Rotman lens", IEEE, 2008.

Fabio Spinello et al.: "High-Order Vortex Beams Generation in the Radio-Frequency Domain", IEEE Antennas and Wireless Propagation Letters, pp. 889-892, vol. 15, 2016.

Ming Su, Lin Yuan and Yuanan Liu: "A Linearly Polarized Radial-Line Dielectric Resonator Antenna Array", IEEE Antennas and Wireless Propagation Letters, vol. 16, pp. 788-791, Apr. 3, 2017.

Yu Yao, Xianling Liang, Weiren Zhu, Junping Geng, and Ronghong Jin: "Phase Mode Analysis of Radio Beams Carrying Orbital Angular Momentum", IEEE Antennas and Wireless Propagation Letters, vol. 16, pp. 1127-1130, May 8, 2017.

Marek Klemes, Halim Boutayeb, and Fayez Hyjazie: "Minimal-hardware 2-D steering of arbitrarily large circular arrays", IEEE conference on Phased Array Systems and Technology (PAST 2016), Waltham MA, USA, Oct. 2016.

Weite Zhang, Shilie Zheng, Xiaonan Hui, Yiling Chen, Xiaofeng Jin, Hao Chi, and Xianmin Zhang: "Four-OAM-Mode Antenna With Traveling-Wave Ring-Slot Structure", IEEE Antennas and Wireless Propagation Letters, vol. 16, pp. 194-197, Feb. 20, 2017.

Zhi-Gui Guo and Guo-Min Yang: "Radial Uniform Circular Antenna Array for Dual-Mode OAM Communication", IEEE Antennas and Wireless Propagation Letters, vol. 16, pp. 404-407, Mar. 6, 2017.

Zongtang Zhang, Shaoqiu Xiao, Yan Li,. and Bing-Zhong Wang: "A Circularly Polarized Multimode Patch Antenna for the Generation of Multiple Orbital Angular Momentum Modes", IEEE Antennas and Wireless Propagation Letters, vol. 16, pp. 521-524, Mar. 20, 2017.

Kuangda Wang and Ke Wu: "Liquid Crystal Enabled Substrate Integrated Waveguide Variable Phase Shifter for Millimeter-Wave Applications at 60 GHz and Beyond", Proceedings of IEEE International Microwave Symposium IMS, 2015.

Tiezhu Yuan, Hongqiang Wang, Yuliang Qin and Yongqiang Cheng, "Electromagnetic Vortex Imaging Using Uniform Concentric Circular Arrays" IEEE Antennas and Wireless Propagation Letters, vol. 15, pp. 1024-1027, 2016.

Extended European Search Report dated Jun. 4, 2020 re: EP Patent Application No. 18816932.0 2020.

* cited by examiner $$\begin{bmatrix} C \\ D \end{bmatrix} = \frac{1}{\sqrt{2}} \begin{bmatrix} 1 & 1 \\ 1 & -1 \end{bmatrix} \bullet \begin{bmatrix} A \\ B \end{bmatrix}$$

ADJUSTABLE STACKED PHASE-MODE FEED FOR 2D STEERING OF ANTENNA ARRAYS

FIELD

The present disclosure relates to beam-steering of antenna arrays. In particular, the present disclosure relates to a stacked phase-mode feed network for antenna arrays.

BACKGROUND

An antenna array is a set of individual radiating elements, connected together to act as a single antenna, with a main beam or lobe. Conventionally, an antenna array may be referred to as a single antenna. Beam steering is the angular positioning of the main beam by controlling the amplitude and/or phase of the individual radiating elements. Beam steering allows the antenna array to transmit in a preferential direction, namely the direction of the main beam, or provide increased reception sensitivity to signals received from the direction of the main beam. In order to obtain a desired radiation pattern for the main beam, different phase modes of the antenna array may be combined.

Circuitry for beam steering may comprise individual phase-shifters and/or delay units for each of the individual radiating elements that make up the antenna array. As the target frequency range of an antenna increases, the ideal spacing of radiating elements in the array decreases. The reduced spacing between radiating elements may increase the complexity in implementing the beam steering circuitry and feed network used to connect to the radiating elements, as the beam steering circuitry and feed network generally do not scale with wavelength, unlike antenna structures.

SUMMARY

In order to achieve a main beam having a greater tilt from the z-axis (i.e., greater radial steering range, or polar angle), it may be necessary to combine higher order phase modes of the antenna array.

In various examples, a sparse phase-mode feed network is described. The feed network enables any number of radiating elements in an antenna array to be fed by a smaller number of phase-mode feed probes. In examples disclosed herein, the feed network includes two feed ports and no Butler matrix, to feed any arbitrary number of radiating elements. Two waveguides are stacked, each waveguides serving one of two rings of a concentric antenna array. The disclosed configuration enables forming two consecutive-order phase modes, with the order of the phase modes adjustable by a control signal.

In some examples, the present disclosure describes a feed network for a steerable antenna array. The feed network includes a waveguide assembly including first and second radial transverse electromagnetic (TEM) waveguides, and first and second variable phase shifters. The first radial TEM waveguide includes a first plurality of radiating element probes for coupling to a first ring of radiating elements of the antenna array and the second radial TEM waveguide includes a second plurality of radiating element probes for coupling to a second ring of radiating elements of the antenna array. The first variable phase shifter is positioned in the first radial TEM waveguide. The first variable phase shifter is configured to cause additional progressive electrical phase shifts in the first ring of radiating elements, directly proportional to angular position of the radiating elements in the first ring, from 0 to an integer multiple of $2\pi$ radians, the integer multiple being controllable. The second variable phase shifter is positioned in the second radial TEM waveguide. The second variable phase shifter is configured to cause additional progressive electrical phase shifts in the second ring of radiating elements, directly proportional to angular position of the radiating elements in the second ring, from 0 to an integer multiple of $2\pi$ radians, the integer multiple being controllable. The feed network also includes first and second phase-mode feed probes coupled to the first and second radial TEM waveguides, respectively. The phase-mode feed probes provide respective phase-mode feed ports. When the feed network is coupled to the antenna array, two consecutive-order phase modes are provided at the phase-mode feed ports. The orders of the phase modes are selectable in accordance with at least one phase shift control signal controlling the integer multiple of the first and second variable phase shifters.

In any of the above embodiments/aspects, the waveguide assembly may be configured for a concentric circular antenna array. The first radial TEM waveguide may be configured to couple to an inner concentric ring of the antenna array and the second radial TEM waveguide may be configured to coupled to an outer concentric ring of the antenna array. The first and second radial TEM waveguides may be concentrically stacked on each other.

In any of the above embodiments/aspects, a lower order of the consecutive-order phase modes may be obtained from the first radial TEM waveguide, and a higher order of the consecutive-order phase modes may be obtained from the second radial TEM waveguide.

In any of the above embodiments/aspects, a higher order of the consecutive-order phase modes may be obtained from the first radial TEM waveguide, and a lower order of the consecutive-order phase modes may be obtained from the second radial TEM waveguide.

In any of the above embodiments/aspects, the waveguide assembly may be configured for a polygonal antenna array.

In any of the above embodiments/aspects, the first and second phase-mode feed probes may be coaxially arranged In any of the above embodiments/aspects, the first and second variable phase shifters may be liquid crystal analog phase shifters.

In any of the above embodiments/aspects, separate first and second phase shift control signals may be used to control the integer multiple of the first and second variable phase shifters, respectively. The first variable phase shifter may be controlled to cause phase shifts in the first ring of radiating elements from 0 to $K2\pi$ radians. The second variable phase shifter may be controlled to cause phase shifts in the second ring of radiating elements from 0 to $(K+1)\ 2\pi$ radians, K being an integer. The phase modes provided at the phase-mode feed ports may be K-th and K+1-th order phase modes.

In any of the above embodiments/aspects, the feed network may include a fixed spiral phase shifter in the first radial TEM waveguide. The fixed spiral phase shifter may be configured to cause additional progressive electrical phase shifts in the first ring of the antenna array from 0 to $2\pi$ radians. The first and second variable phase shifters may be controlled by a common phase shift control signal.

In any of the above embodiments/aspects, the waveguide assembly may be configured for an antenna array having circularly polarized radiating elements. The first and second variable phase shifters may be controlled by a common phase shift control signal.

In some aspects, the present disclosure describes an apparatus for beam steering a steerable antenna array. The apparatus includes any of the above embodiments of the feed network and a beam steering circuitry. The beam steering circuitry is coupled to the phase-mode feed ports of the feed network. The beam steering circuitry is configured to combine the two consecutive-order phase modes to generate a main beam of the steerable antenna array. The beam steering circuitry controls the polar angle and azimuth angle of the main beam to direct the main beam in a selected direction.

In any of the above embodiments/aspects, the beam steering circuitry may include a monitoring and control sub-circuit configured to monitor signal strength of at least one of the phase modes and provide feedback for the phase shift control signal.

In some aspects, the present disclosure describes a steerable antenna array system. The system includes a plurality of radiating elements arranged in a planar antenna array. The system also includes any of the above embodiments of the feed network and any of the above embodiments of the beam steering circuitry.

In any of the above embodiments/aspects, the planar antenna array may be a circular antenna array, and the radiating elements may be arranged in concentric rings.

In any of the above embodiments/aspects, the planar antenna array may be a polygonal antenna array, and the radiating elements may be arranged in concentric polygons.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

The present disclosure describes a sparse phase-mode feed network that does not require a full N-port network to feed N radiating elements in an antenna array. In examples described below, two feed probes are used to feed two stacked waveguides. The phase-modes at the two phase-mode ports are two consecutive order phase-modes (generally referred to as $P_K$ and $P_{K+1}$), which may be selected using a control signal to control K. The example configurations disclosed herein may enable simple planar construction, without use of a Butler matrix. Because a Butler matrix is not required, space savings and reduction of feed losses may be achieved. The disclosed feed network may interface with any suitable beam steering circuitry, such as any beam steering circuitry designed for circular antenna arrays.

Examples described below may be suitable for use with a planar circular antenna array with two concentric rings of radiating elements. An example of an antenna array with concentric rings of radiating elements is described by Tiezhu Yuan, Hongqiang Wang, Yuliang Qin, and Yongqiang Cheng in "Electromagnetic Vortex Imaging Using Uniform Concentric Circular Arrays" *IEEE Antennas and Wireless Propagation Letters*, Vol. 15, pp. 1024-1027, 2016, incorporated herein by reference in its entirety.

Spatial combining of the fields generated by the concentric radiating elements, fed by two consecutive phase-modes, result in a 2D steerable beam with a desired tilt from the z-axis. A variable ratio combiner (VRC) may also be implemented in the beam steering circuitry, as discussed further below.

Figure 1:
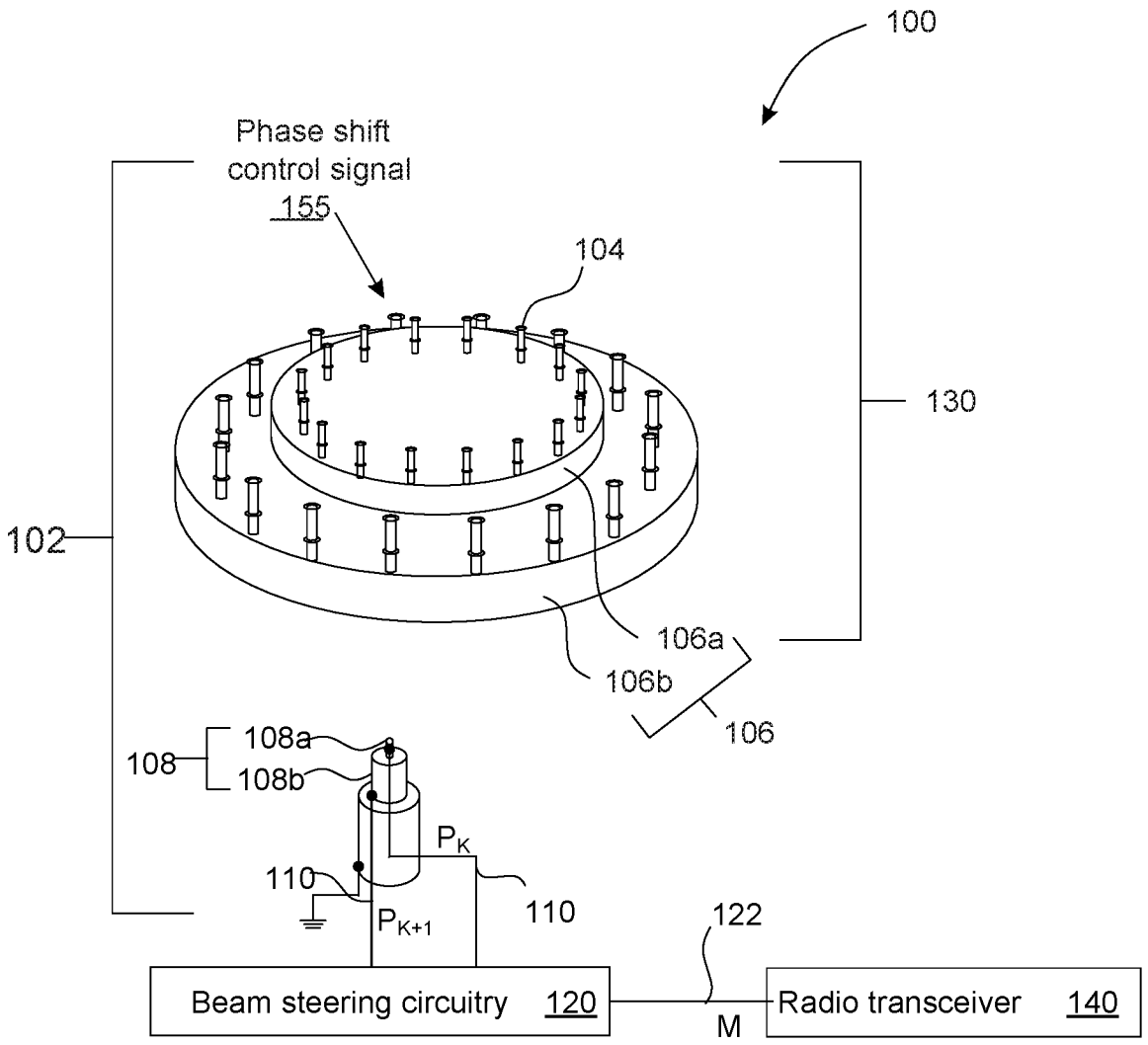
FIG. 1 is a schematic diagram illustrating an example system for beam steering of a planar circular antenna array.

FIG. 1 schematically illustrates components of an example system for beam steering of a steerable antenna array. The system 100 may be used for both transmission and reception. The system 100 includes a circular antenna array (not shown) and a feed network 102. Although other antenna array arrangements may be suitable, in examples described herein the antenna array has a set of N radiating elements (not shown) arranged in a planar circular array of two concentric rings. Generally, the antenna array may have any arrangement of radiating elements (e.g., in a circular or polygonal configuration), provided the radiating elements are arranged such that they give rise to the phase modes (e.g., radiating elements are arranged concentrically along the perimeter of a polygon). The individual radiating elements are arranged at a spacing of approximately half the wavelength A at which the antenna array is designed to operate. Each of the individual radiating elements is connected to a respective radiating element probe 104 of a radial waveguide transition assembly 130. Each radiating element probe 104 provides the transmission or reception signal to or from the respective radiating element.

In the example shown, the waveguide transition assembly 130 includes two stacked radial transverse electromagnetic (TEM) waveguides 106*a*, 106*b* (generally referred to as radial TEM waveguide 106), with the radiating element probes 104 arranged in a circular pattern in each radial TEM waveguide 106, corresponding to the concentric arrangement of the radiating elements in the antenna array. The construction of the radial TEM waveguide 106 may be similar to that described in U.S. Pat. No. 9,413,067, filed Apr. 25, 2013; U.S. Pat. No. 9,768,503, filed Jun. 3, 2014; U.S. Pat. No. 10,148,009, filed Nov. 23, 2015; and U.S. Pat. No. 10,283,862, filed Oct. 17, 2016; all of which are hereby incorporated by reference in their entireties, with appropriate modifications as described herein. It should be noted that although the TEM waveguides 106 are stacked on each other, the radiating element probes 104 may be coupled to radiating elements that are in the same or different plane. In this example, the TEM waveguides 106 are stacked with the upper radial TEM waveguide 106*a* being smaller than the lower radial TEM waveguide 106*b*. In other examples, the upper radial TEM waveguide 106*a* may be larger than the lower radial TEM waveguide 106*b*. Generally, the upper and lower radial TEM waveguides 106*a*, 106*b* may be referred to as first and second radial TEM waveguides 106*a*, 106*b*. For ease of understanding, the following discussion will refer to upper and lower radial TEM waveguides 106*a*, 106*b*, however it should be understood that the "upper" and "lower" are not intended to be limiting.

In this example, there are two feed probes 108*a*, 108*b* (generally referred to as feed probe 108) coupled to phase-mode feed ports 110 of the feed network 102. Notably, a Butler matrix is not required, which may result in space saving and/or reduction of feed losses due to the Butler matrix. The number of phase-mode feed probes 108 is always two regardless of the number N of radiating elements. In the examples disclosed herein, the two feed probes 108 are provided in a coaxial configuration (also referred to as a triaxial configuration), however other arrangements of the feed probes 108 may also be suitable, for example configurations having more conductor layers and/or having rings, caps or other structures attached for impedance matching and/or tuning purposes.

In FIG. 1, the feed probes 108 are shown separated from the waveguide assembly 130, for clarity, however when implemented the feed probes 108 are connected to the waveguide assembly 130. For example, as shown in FIG. 1, the inner feed probe 108*a* may be connected to the upper radial TEM waveguide 106*a*, and the outer probe 108*b* may be connected to the lower radial TEM waveguide 106*b*. It should be noted that, as shown in FIG. 1, the outer probe 108*b* is not necessarily provided by the outermost conductor of the coaxial feed probes 108. Similarly, the inner probe 108*a* is not necessarily provided by the innermost conductor of the coaxial feed probes 108. In this particular example, the innermost coaxial cylinder of the coaxial feed probes 108 protrudes into the upper radial TEM waveguide 106*a* (e.g., about half-way or ⅛ wavelength into the waveguide 106*a*) and interfaces with the K-th phase-mode signal. The inner surface of the middle cylinder of the coaxial feed probes 108 provides the return path for the currents of the K-th phase-mode interface from the inner surface of the bottom disk of the upper radial TEM waveguide 106*a*. The outer surface of the middle cylinder of the coaxial feed probes 108 forms the interface for the K+1-th phase-mode signal in the lower radial TEM waveguide 106*b* and connects to the top metal disk of the lower radial TEM waveguide 106*b*. Similarly, the inner surface of the outermost cylinder of the coaxial feed probes 108 connects to the bottom disk of the lower radial TEM waveguide 106*b* and provides the return path for the currents of the K+1-th phase-mode interface. All three coaxial conductors of the coaxial feed probes 108 are separated by dielectric materials and their bottom ends can terminate in the same plane at or below the bottom conductor disk of the lower radial TEM waveguide 106*b*.

When the phase-mode feed ports 110 are coupled to the phase-mode feed probes 108, each of the phase-mode feed ports 110 may correspond to the antenna array transmitting, or receiving, signals according to a respective one of two consecutive-order phase modes $P_K$ and $P_{K+1}$, discussed further below. Although FIG. 1 shows the outer feed probe 108*b*, when connected to the lower radial TEM waveguide 106*b*, providing the K+1-th phase mode and the inner feed probe 108*a*, when connected to the upper radial TEM waveguide 106*a*, providing the K-th phase mode, this may be reversed, as discussed further below.

The phase-mode feed ports 110 are coupled to a beam steering circuitry 120, which provides a steered main beam M at a main port 122. Examples of suitable beam steering circuitries are described in the above-referenced U.S. patent applications.

The beam steering circuitry 120 may combine signals from the two phase-mode feed ports 110 to obtain a desired main beam M directed at a desired direction. For example, the two consecutive-order phase modes of the antenna array may be combined to achieve a desired tilt, or polar angle, of the main beam M. It has been found that combination of phase modes that differ by one results in a main beam M that may be more easily steered circumferentially using simple phase control. The beam steering circuitry 120 may control the radial (i.e., polar angle) and circumferential (i.e., azimuth angle) directions of the main beam M in order to enable scanning of the antenna array in desired directions. A phase shift control signal 155 is used to control phase shift of the radiating elements of the antenna array so as to create the requisite phase-modes. The phase shift control signal 155 is used to control a variable phase shifter (not shown in FIG. 1) in each of the radial TEM waveguides 106, discussed further below. The variable phase shifter is shown as a spiral in various figures for the purpose of illustration only. Further, the variable phase shifter may be incorporated into the waveguide assembly 130 and may not be visible externally. The phase shift control signal 155 may be outputted to the variable phase shifter from the beam steering circuitry 120 or from a separate circuitry. The main beam M, provided at the main port 122 of the beam steering circuitry 120, is provided to a radio transceiver 140 for use in transmission/reception. An auxiliary output, such as auxiliary signals A1 and/or A2 (see FIG. 7), may also be provided for purposes such as interference mitigation or direction-finding.

An example configuration of the radial TEM waveguide 106 is now described. The upper and lower radial TEM waveguides 106*a*, 106*b* may be similar in construction and the following description may be similarly applicable to both the upper and lower radial TEM waveguides 106*a*, 106*b*. In an example, the upper and lower radial TEM waveguides 106*a*, 106*b* differ in radii by half of wavelength A in the dielectric material used in their construction. This λ/2 difference in radii between the upper and lower radial TEM waveguides 106*a*, 106*b* was found to achieve a main beam M with reduced side lobes. However, other dimensions may also be suitable.

The example configuration described here may be suitable for use with a planar circular antenna array. In an example, each radial TEM waveguide 106 includes substantially parallel conductive circular disks separated by about ¼ wavelength λ in dielectric. The total thickness of the stacked waveguide assembly 130 is then less than or equal to about half wavelength λ in air. The N radiating element probes 104 are about ¼ wavelength λ from a circumferential vertical conductive wall joining the top and bottom circular disks in each radial TEM waveguide 106. In the example shown, each radial TEM waveguide 106 has the same number of probes 104 (corresponding to the configuration of radiating elements in the antenna array). In the lower radial TEM waveguide 106*b*, the probes 104 are spaced slightly wider than half-wavelength, and in the upper radial TEM waveguide 106*a*, the probes 104 are spaced slightly closer than half-wavelength; the average spacing of all the probes 104 is about half-wavelength. In other examples, there may be different numbers of probes 104 for the two TEM waveguides 106, and the spacing of the probes 104 may be different. In this example, the radial spacing between the probes 104 of the upper and lower TEM waveguides 106 is about half-wavelength, but this may also be varied. The N outer radiating element probes 104 have their outer conductors connected to the top disk and their inner conductors protruding about ⅛ wavelength λ into the space between the disks, but not touching the bottom disk. The other ends of the N radiating element probes 104 inner conductors are connected to the radiating elements via matched-impedance element-feed planar or non-planar networks. This planar construction may enable easier incorporation into the antenna array and feed network.

Example dimensions and properties of the above example configuration are now described. In some examples, λ=1.876 mm. The example dielectric used in the coaxial probes and between the disks has the following properties: $\varepsilon_r$=7.1, DuPont 9K7 LTCC material, f=60 GHz. In each TEM waveguide 106, the separation between parallel metal disks=0.53 mm (i.e., 0.2824λ or approximately λ/4). The probe height between the top pair of the parallel metal circular disks (defining the upper radial TEM waveguide 106*a*)=0.234 mm (i.e., approximately λ/8). The innermost conductor of the coaxial probes has a diameter of 115 μm (about 0.0617λ). The central conductor has an outer diameter of 200 μm (or about λ/10). The diameters of the inner and central conductors in the coaxial feed probe assembly 108 should have the same ratio as the diameters of the central and outer conductors. Thus, the outermost conductor has an outer diameter of 348 μm, or about 0.16 to 0.1854λ (not accounting for the thickness of the metal). In some examples, cylindrical coaxial structures may be added to the coaxial conductors of each of the central feed probes 108 in order to optimize their impedance matches to their respective radial TEM waveguides 106. The characteristic impedances of the concentric inner and outer coaxial probes in this example are 12.06 Ohms.

The radiating element probes 104 may have inner and outer diameters of 115 μm (about 0.0617λ) and 200 μm (or about λ/10), respectively, or other dimensions that facilitate matching of the element impedances to that of the radial TEM waveguides 106. In the upper radial TEM waveguide 106*a*, the element probes 104 may be placed uniformly around a circle of a radius that is about λ/4 smaller than that required to space them at λ/2 intervals around its circumference, i.e. 1.9196 mm. The vertical conductive wall connecting the top and bottom metal disks of the upper radial TEM waveguide 106*a* may have a radius of 2.3886 mm, which would place it λ/4 farther from center than the element probes 104. The element probes 104 in the lower radial TEM waveguide 106*b* may be evenly spaced at a radius about λ/4 larger than the outer wall of the upper waveguide 106*a*, or about 2.8576 mm, and the outer vertical wall connecting the top and bottom disks of the lower radial TEM waveguide 106*b* may have a radius about λ/4 larger than that of the circle of its element probes 104, or about 3.3266 mm.

As also demonstrated in other disclosures noted above, the radiating elements themselves may be built into the top metallic disks of the TEM waveguides 106, such as crossed slots, omitting the element probes 104 entirely.

Figure 2:
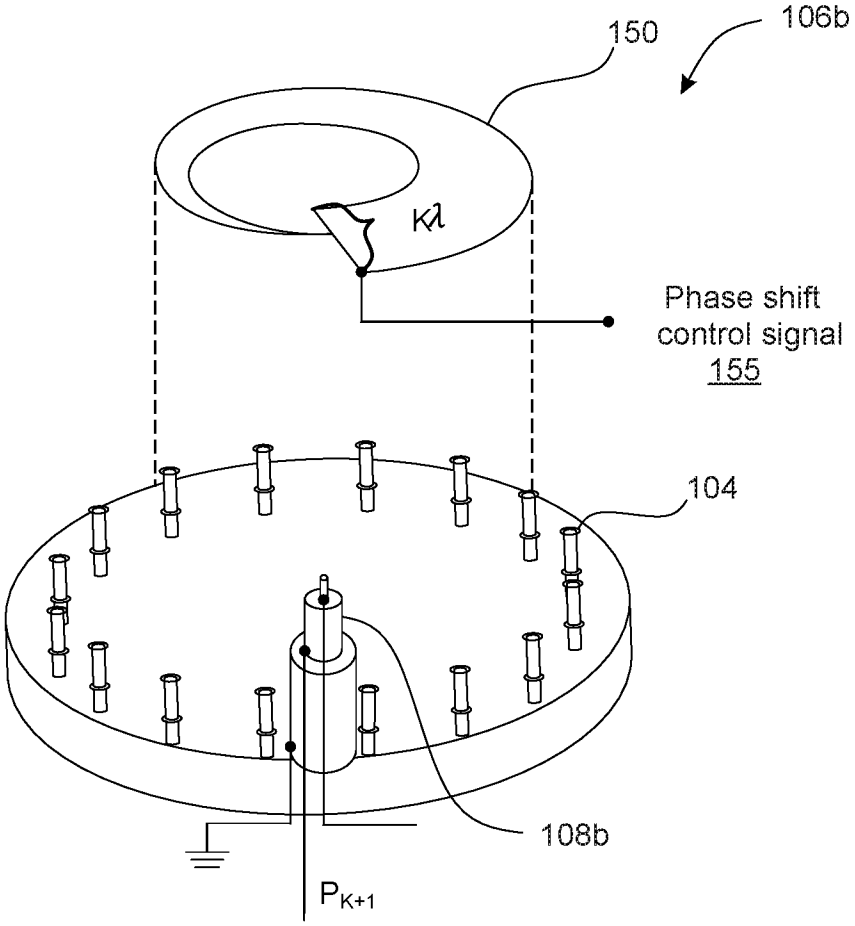
FIG. 2 schematically illustrates the incorporation of a variable phase shifter into one waveguide in the waveguide assembly of the feed network shown in FIG. 1.

FIG. 2 schematically represents a variable phase shifter 150 incorporated into one radial TEM waveguide 106, in this example the lower radial TEM waveguide 106*b*. It should be understood that another variable phase shifter 150, of similar or identical construction (e.g., smaller dimensions or same dimensions), may be similarly incorporated into the upper radial TEM waveguide 106*a*. The variable phase shifter 150 is positioned in the radial TEM waveguide 106*b* such that the TEM wave propagating radially between the radiating element probes 104 and the corresponding phase-mode feed probe 108*b* experiences an electrical phase shift ranging linearly from 0 to K2π radians (corresponding to radial propagation distance of Kλ) with the azimuthal angular direction of propagation inside the radial TEM waveguide 106*b*. The variable phase shifter 150 thus causes additional phase shift at the radiating elements, from a phase shift of 0 to a phase shift of an integer multiple of 2π radians, denoted K2π, where K is a selectable integer value corresponding to the order of the phase mode and K is controlled by the phase shift control signal 155, where the phase shift progresses for one complete physical angular cycle around the plane of the TEM waveguide 106*b*. The phase shifter 150 causes a phase shift in the radiating elements that progresses linearly from 0 to K2π radians. That is, the phase shifter 150 causes a phase shift in the radiating elements that is directly proportional to the angular position of the radiating elements in the circle. Generally, for N evenly-spaced radiating elements, the variable phase shifter 150 causes an additional phase shift at the m-th radiating element that is equal to (mK2π)/N radians. Where the radiating elements are arranged in a circular arrangement in a planar circular antenna array, the radiating element at a first position has an additional phase shift of (K2π)/N radians, and the phase shift linearly increases in a circular direction (as represented as a spiral shown in FIG. 2) such that the radiating element at the Nth position (which is adjacent to the first position) has an additional phase shift of K2π radians. In some examples, the phase shift control signal 155 may be provided as an adjustable voltage signal proportional to K. The phase shift control signal 155 may be provided by the beam steering circuitry 120 or by a separate circuitry.

Figure 3:
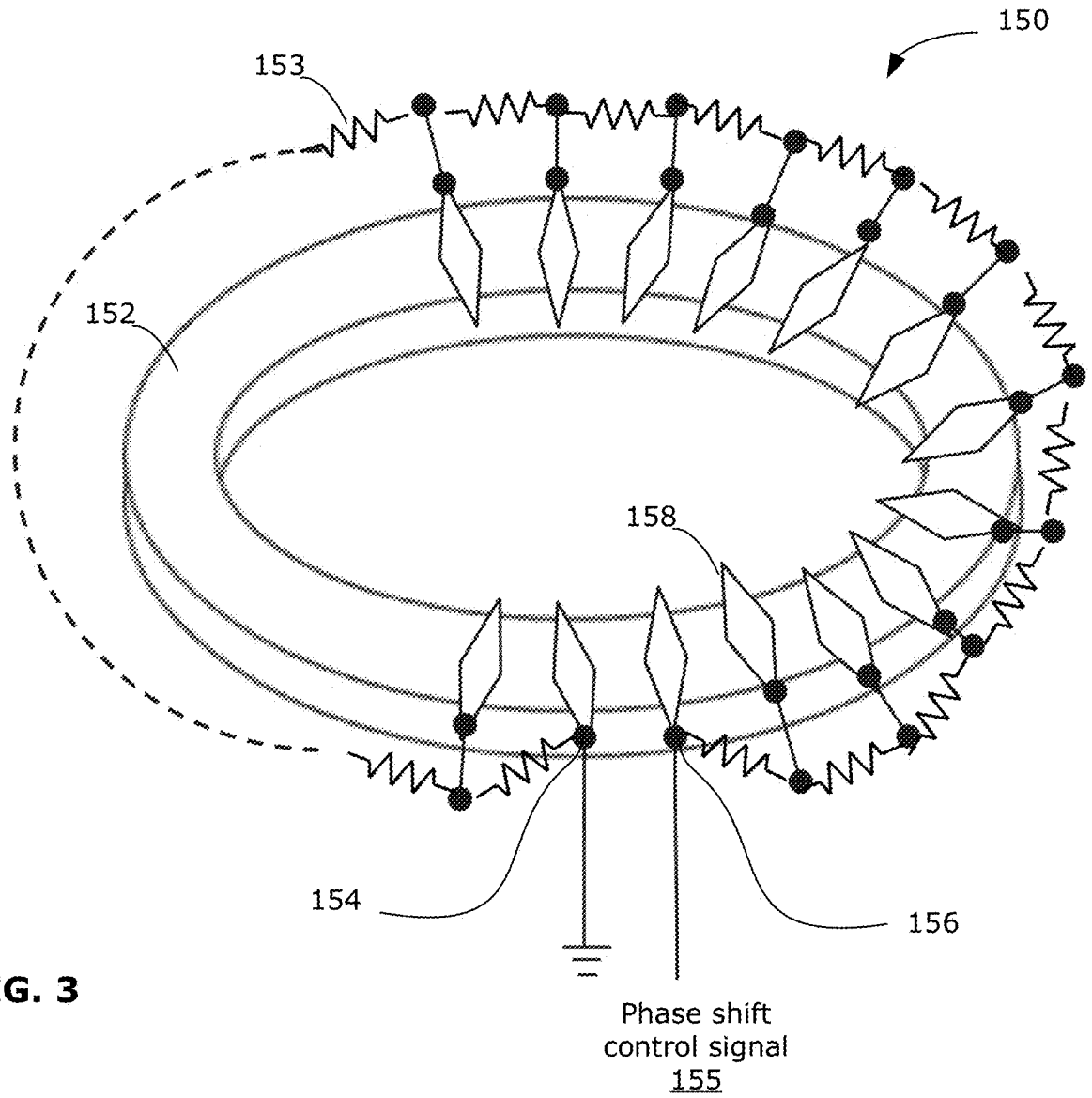
FIG. 3 is a schematic diagram illustrating an example liquid-crystal analog implementation of a variable phase shifter.

FIG. 3 is a schematic diagram illustrating an example liquid-crystal analog implementation of the variable phase shifter 150. The example variable phase shifter 150 shown in FIG. 3 may be incorporated into the dielectric between the two disks of the radial TEM waveguide 106, for example. In this example, the variable phase shifter 150 has a circular configuration, to cause phase shift in a planar circular antenna array. The variable phase shifter 150 may be configured similarly to the liquid-crystal analog phase shifter described in U.S. patent application Ser. No. 14/603,908 filed Jan. 23, 2015, incorporated herein by reference in its entirety. In the example of FIG. 3, the spiral phase shifter 150 has a torus-shaped liquid crystal compartment 152. The liquid crystal compartment 152 may be similar to that described by Kuangda Wang and Ke Wu in "Liquid Crystal Enabled Substrate Integrated Waveguide Variable Phase Shifter for Millimeter-Wave Applications at 60 GHz and Beyond", *Proceedings of IEEE International Microwave Symposium IMS,* 2015, incorporated herein by reference in its entirety.

A plurality of electrodes 158 are positioned radially around the liquid crystal compartment 152 and are connected by identical resistors 153. The variable phase shifter 150 has a first end 154 connected to ground, and a second end 156 that receives the phase shift control signal 155 (which may be in the form of a control voltage). The variable phase shifter 150 generates an electric field that causes the progressive phase shift in the radiating elements. It should be noted that the number of electrodes 158 does not necessarily correspond to the number of radiating elements in the antenna array. However, it may be useful for the number of electrodes 158 to be at least equal to the number of radiating elements, to ensure that the phase shift caused in the radiating elements progresses linearly from 0 to K2π, which effects a K-th order phase mode. Other configurations for the variable phase shifter 150 may be used. For example, where the antenna array has a non-circular arrangement of radiating elements, the variable phase shifter 150 may correspondingly be non-circular in shape. It should be noted that the variable phase shifter 150 is positioned in the radial TEM waveguide 106 to occupy the annular region between the phase-mode feed probes 108 and the radiating element probes 104.

Figure 4:
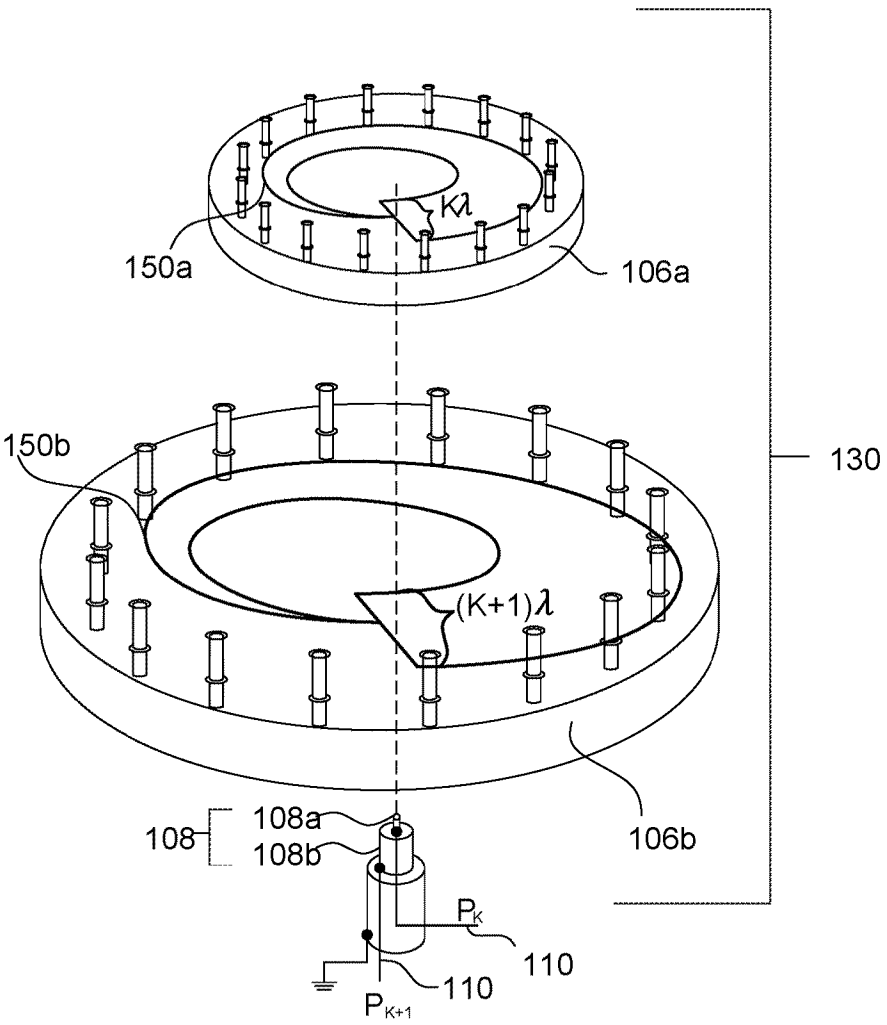
FIG. 4 is a schematic diagram illustrating a stacked waveguide assembly, showing incorporation of variable phase shifters into each waveguide.

FIG. 4 illustrates the stacked waveguide assembly 130, with a respective variable phase shifter 150 incorporated into each radial TEM waveguide 106. For clarity, FIG. 4 illustrates the upper and lower TEM waveguides 106*a*, 106*b* and the feed probes 108 in an exploded view. In this example, the upper radial TEM waveguide 106*a* is provided with a first variable phase shifter 150*a*, which causes a linear phase shift around the radial TEM waveguide 106*a* from 0 to K2π, giving rise to the K-th order phase mode. The lower radial TEM waveguide 106*b* is provided with a second variable phase shifter 150*b*, which causes a linear phase shift around the radial TEM waveguide 106*a* from 0 to (K+1)2π, giving rise to the K+1-th order phase mode. As will be discussed further below, the order of the phase modes may be reversed, such that the K-th order phase mode arises from the lower radial TEM waveguide 106*b* and the K+1-th order phase mode arises from the upper radial TEM waveguide 106*a*. The variable phase shifters 150*a*, 150*b* may be controlled by a common phase shift control signal 155, with appropriate circuitry being used to split and modify the phase shift control signal 155 into separate signals proportional to K and K+1, for example. Alternatively, two separate phase shift control signals 155 may be used, with the two phase shift control signals 155 being separately proportional to K and K+1.

Figure 5:
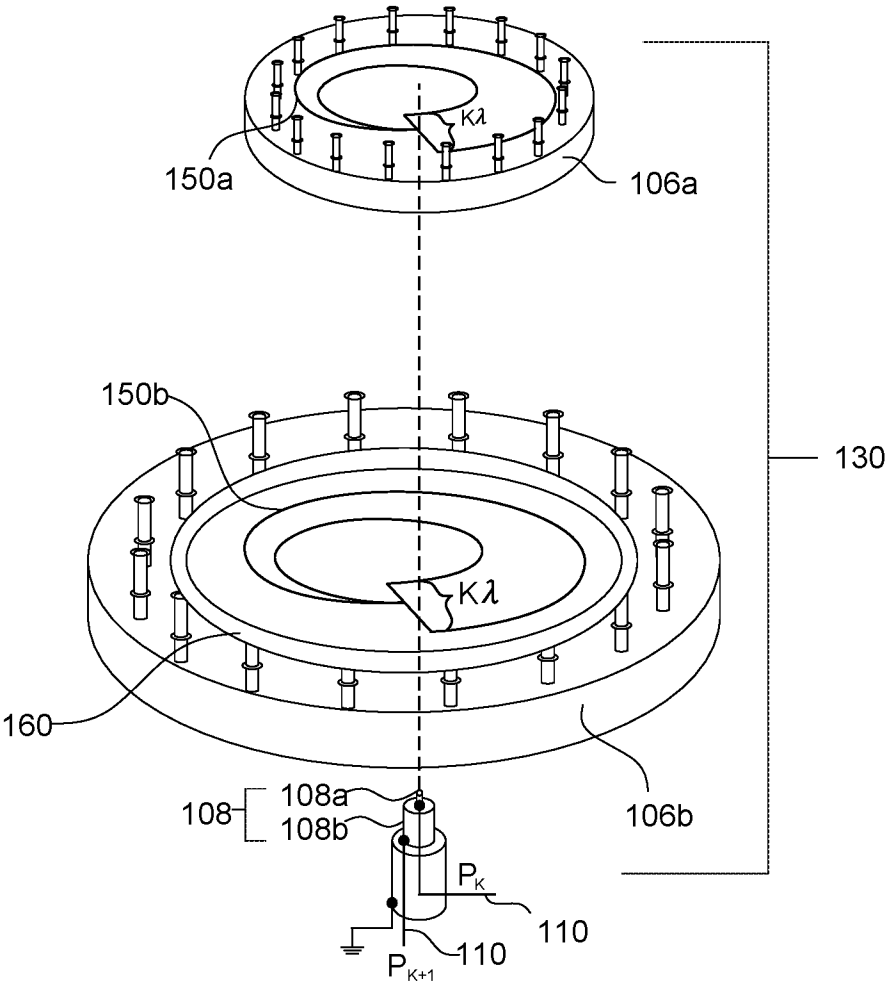
FIG. 5 is a schematic diagram illustrating a stacked waveguide assembly, showing incorporation of variable phase shifters and a fixed phase shifter into the waveguides.

Alternatively, a common phase shift control signal 155, proportional K, may be used to directly control both variable phase shifters 150*a*, 150*b* with the addition of a fixed spiral phase shifter, as schematically illustrated in FIG. 5 in an exploded view. The configuration shown in FIG. 5 may be similar to that of FIG. 4. However, both the first and second variable phase shifters 150*a*, 150*b* may be controlled by a common phase shift control signal 155 such that both the first and second variable phase shifters 150*a*, 150*b* give rise to a linear phase shift from 0 to K2π. One of the radial TEM waveguides 106 (the lower radial TEM waveguide 106*b* in this example) may be provided with a fixed spiral phase shifter 160 that causes a linear phase shift from 0 to 27 around the radial TEM waveguide 106*b*, such that the total linear phase shift around the radial TEM waveguide 106*b* is 0 to (K+1)2π. Thus, the configuration illustrated in FIG. 5 may achieve the same output at the phase-mode feed ports 110 as the configuration in FIG. 4, however the configuration illustrated in FIG. 5 enables a single common phase shift control signal 155 to be used to directly control both the first and second variable phase shifters 150*a*, 150*b*. It should be understood that the fixed spiral phase shifter 160 may be provided for the upper radial TEM waveguide 106*a* instead, in order to obtain the K+1-th order phase mode from the upper radial TEM waveguide 106*a*. The fixed spiral phase shifter 160 may be implemented in a manner similar to that shown in FIG. 3, but without variable control.

It should be understood that the fixed spiral phase shifter 160 may be provided for the upper radial TEM waveguide 106*a* instead, such that the K+1-th order phase mode arises from the upper radial TEM waveguide 106*a*.

Figure 6:
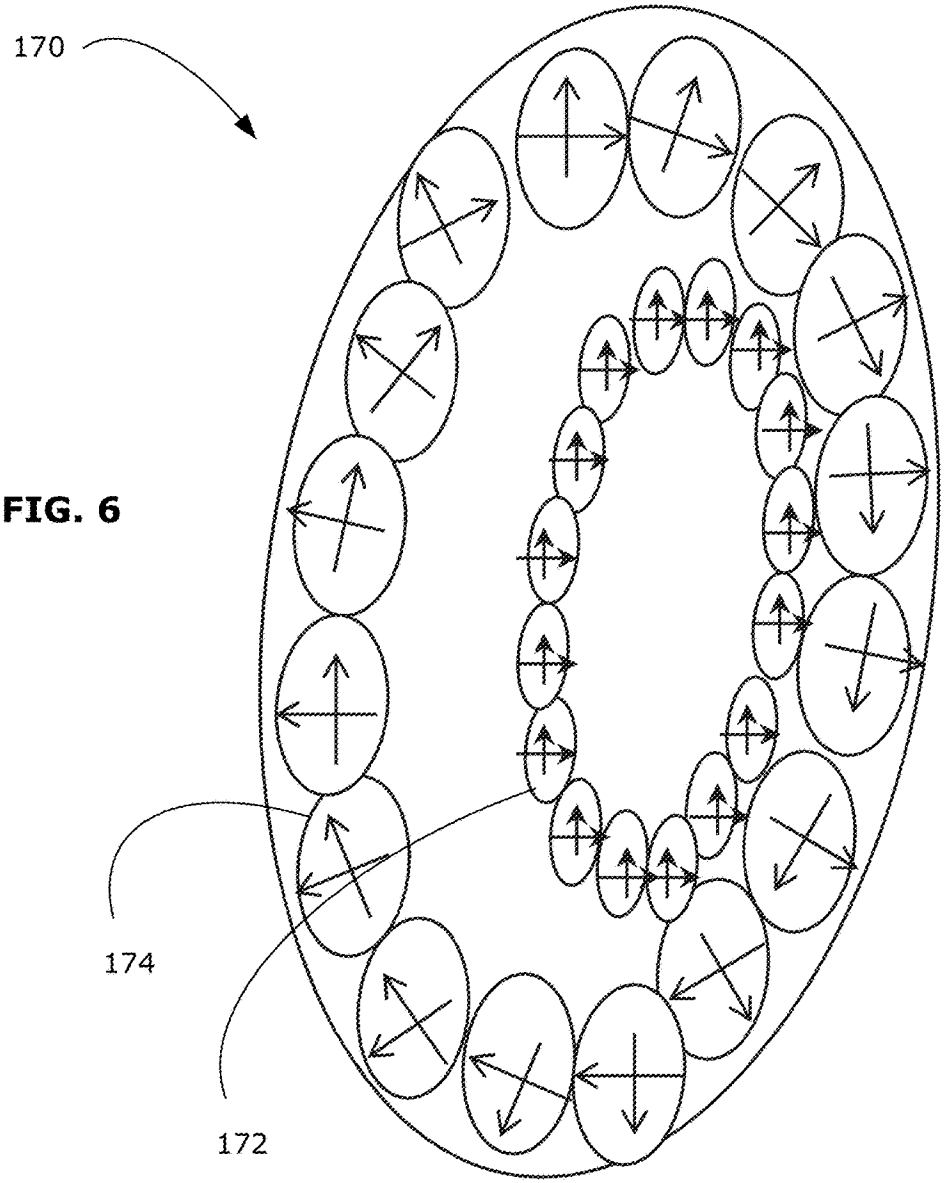
FIG. 6 is a schematic diagram illustrating orientation of circularly polarized radiating element, to achieve a first-order phase mode increment.

Alternatively, instead of using the fixed spiral phase shifter 160, a first-order phase mode increment may be achieved by appropriate orientation of the radiating elements, in the case where the radiating elements are circularly polarized. FIG. 6 is a schematic diagram illustrating example orientation of circularly polarized radiating elements in a circular antenna array. In this example, the antenna array 170 includes radiating elements arranged in an inner ring 172 and a concentric outer ring 174. The radiating elements of the inner ring 172 are coupled to the upper radial TEM waveguide 106*a* (not shown in FIG. 6) and the radiating elements of the outer ring 174 are coupled to the lower radial TEM waveguide 106*b* (not shown in FIG. 6). As shown in FIG. 6, the polarization references of the radiating elements in the inner ring 172 are aligned in the same direction, and the polarization references of the radiating elements in the outer ring 174 are aligned in radial directions. Thus, a first-order phase mode increment is effected in the outer ring 174, due to the orientation of the circularly polarized radiating elements in the outer ring 174, and the fixed spiral phase shifter 160 is not needed. Using the arrangement shown in FIG. 6, a single common phase shift control signal 155 (proportional to K) to be used to directly control both the first and second variable phase shifters 150*a*, 150*b*, the first and second variable phase shifters 150*a*, 150*b* may be essentially identical and controlled to provide the same phase shift, and a fixed spiral phase shifter 160 is not required.

It should be understood that a similar arrangement may be used where the polarization references of the radiating elements progress in the opposite direction, to effect a first-order phase mode decrement. Further, the radial alignment of the polarization references may be switched between the inner and outer rings 172, 174. That is, the polarization references of the radiating elements in the outer ring 174 may be aligned in the same direction and the polarization references of the radiating elements in the inner ring 172 may be radially aligned.

Thus, FIGS. 4, 5 and 6 show alternative approaches to achieving two consecutive-order phase modes at the phase-mode feed ports 110. The approach that is implemented may be selected based on factors such as cost, size and/or antenna characteristics. For example, the configuration shown in FIG. 6 may be limited to only antennas having circularly polarized radiating elements. The configuration shown in FIG. 4 may require the use of two separate phase shift control signals 155, however may provide greater flexibility in selecting which TEM waveguide 160 effects the higher-order phase mode. The basic main beam steering effect that is produced is not dependent on which of the arrangements of FIG. 4, 5 or 6 is used. Whether the higher-order phase mode results from the upper radial TEM waveguide 106*a* or the lower radial TEM waveguide 106*b* may be selected depending on the desired beam shape, as discussed further below.

Figure 7:
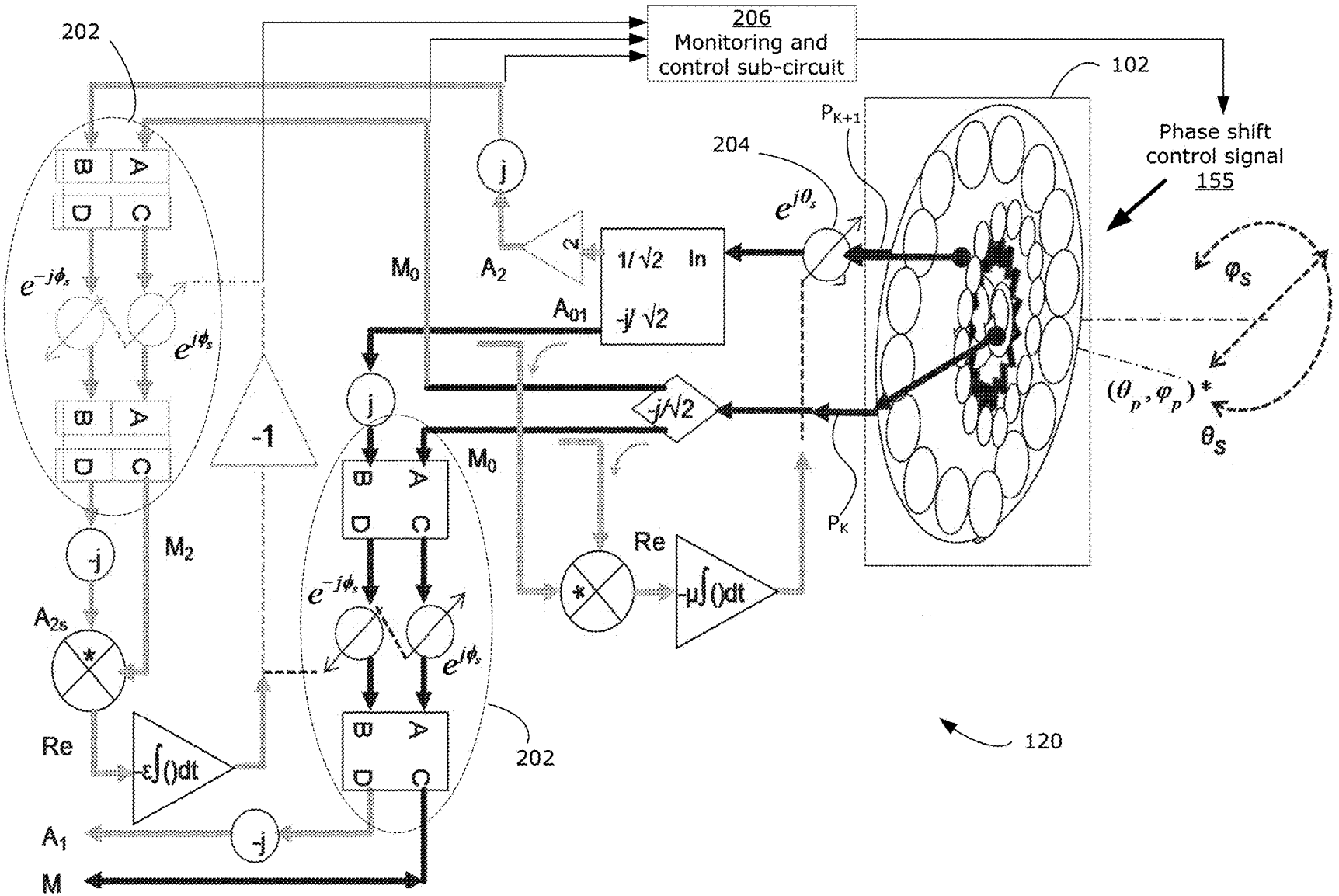
FIG. 7 is a schematic diagram of an example beam steering circuitry suitable for use in the system of FIG. 1.

FIG. 7 shows an example of the beam steering circuitry 120, suitable for use with an example feed network 102 as described herein. The beam steering circuitry 120 controls the polar angle $\varphi_s$ and azimuth angle $\theta_s$ of the main beam M. In FIG. 7, the feed network 102 for a circular antenna array is represented as a star shape inside concentric rings of circular patches representing the radiating elements of the antenna array. The spiral shapes inside the star shape represents the variable phase shifters. In this example, two variable phase shifters are shown, however any of the configurations described above, for example as discussed with reference to FIGS. 4, 5 and 6, may be used with the beam steering circuitry 120 of FIG. 7.

In FIG. 7, the $P_{K+1}$ and $P_K$ signals are coupled to the beam steering circuitry 120, and are combined in a selected proportion of amplitude and phase, according to the circuitry shown. The example circuitry includes two variable-ratio couplers (VRCs) 202 that set the polar angle $\varphi_s$ by varying the electrical phase of its internal opposed phase shifters by $\pm\Phi_5$. The VRCs 202 each includes two hybrid splitters/combiners that are coupled to each other via two phase shifters that provide equal but opposite amounts of phase shifts.

Figure 8:
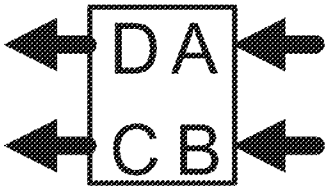
FIG. 8 illustrates an example hybrid splitter/combiner suitable for use in the beam steering circuitry of FIG. 7.

FIG. 8 illustrates an example hybrid splitter/combiner suitable for use in the VRCs 202. The hybrid splitter/combiner may be a 180° hybrid. The relationship between the ports of the hybrid 136 is as shown in FIG. 8.

Referring back to FIG. 7, the $P_{K+1}$ signal is coupled to a phase shifter 204 that sets the azimuth angle $\theta_s$. The output of the beam steering circuitry 120 is the main beam M, as well as an auxiliary signal $A_1$, which may be used for other purposes, including interference mitigation, direction finding and/or feedback control, for example. In the example shown, signals M and $A_1$ are formed from the phase-mode signals as follows:

$$M=(-j/\sqrt{2})[P_K \cos \phi_s - P_{K+1} e^{j\theta_s} \sin \phi_s]$$

$$A_1=(-j/\sqrt{2})[P_K \sin \phi_s + P_{K+1} e^{j\theta_s} \cos \phi_s]$$

The example circuitry in FIG. 7 provides for both azimuthal and radial steering of the main beam. The polar angle is controlled by controlling how the amplitudes of the phase-mode signals are combined, and the azimuth angle is controlled by controlling how the phases of the phase-mode signals are combined. The phase shift control signal 155 controls the amount of phase shift caused by the variable phase shifters of the feed network 102, which in turn determines the two consecutive-order (i.e., K and K+1) of the phase modes coupled to the beam steering circuitry 120. Using the phase shift control signal 155, different values of K can be selected to access higher orders of phase modes. By combining higher orders of phase modes, hence greater axial tilt in the radial direction (i.e., greater values of polar angle $\varphi_s$) can be achieved in the main beam M. The azimuthal steering direction $\theta_s$ can be varied independently over the full physical range of $2\pi$ (corresponding to electrical phase-shift range of $2\pi$) by the phase shifter 204 for any radial tilt direction, including different values of K. The value of K may be selected by iteratively selecting different values of K (e.g., starting from 0 and incrementing by 1 each iteration) and monitoring signals from the beam steering circuitry 120 to select a desired value of K. For example, a monitoring and control sub-circuit 206 may be part of the beam steering circuitry 120. The monitoring and control sub-circuit 206 may include circuitry and/or a processor to monitor the signal strength of one or both of the phase modes, and search for the value of K that achieves a maximum signal. This search for a suitable value of K may be performed by monitoring the phase modes before they are combined into the main beam M, for example using feedback as indicated in FIG. 7. After the appropriate value of K has been selected, the phase shift control signal 155 may control the variable phase shifters of the feed network 102, to obtain the desired consecutive-order phase modes. The steering of the main beam M may be carried out using suitable beam steering techniques.

Figure 9:
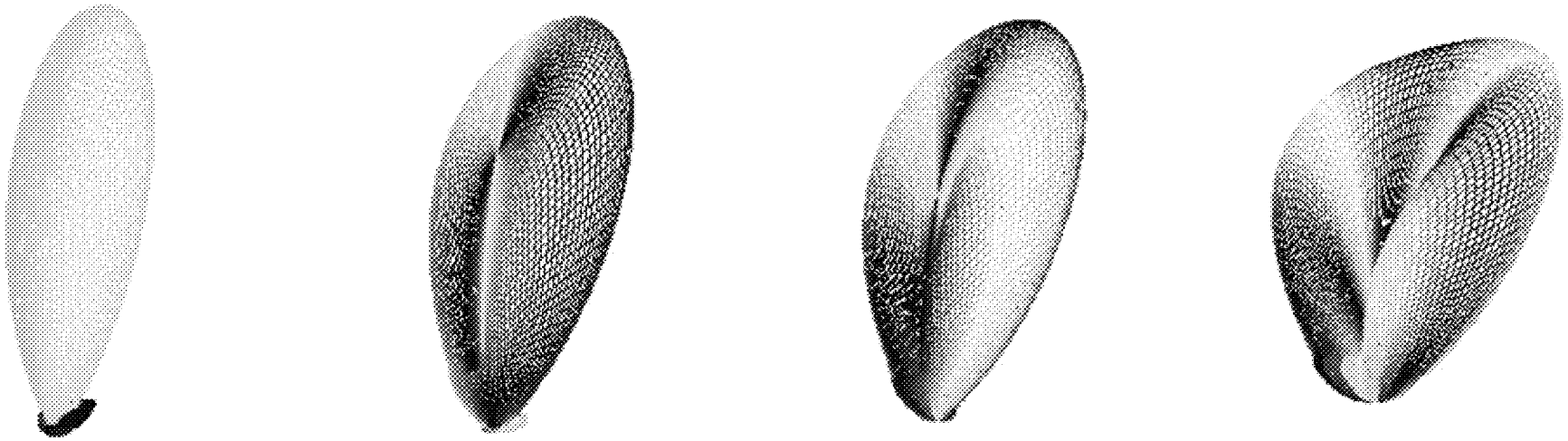
FIG. 9 shows simulations of the radiation pattern of an example main beam, in an example configuration of the stacked waveguide assembly.
Figure 10:
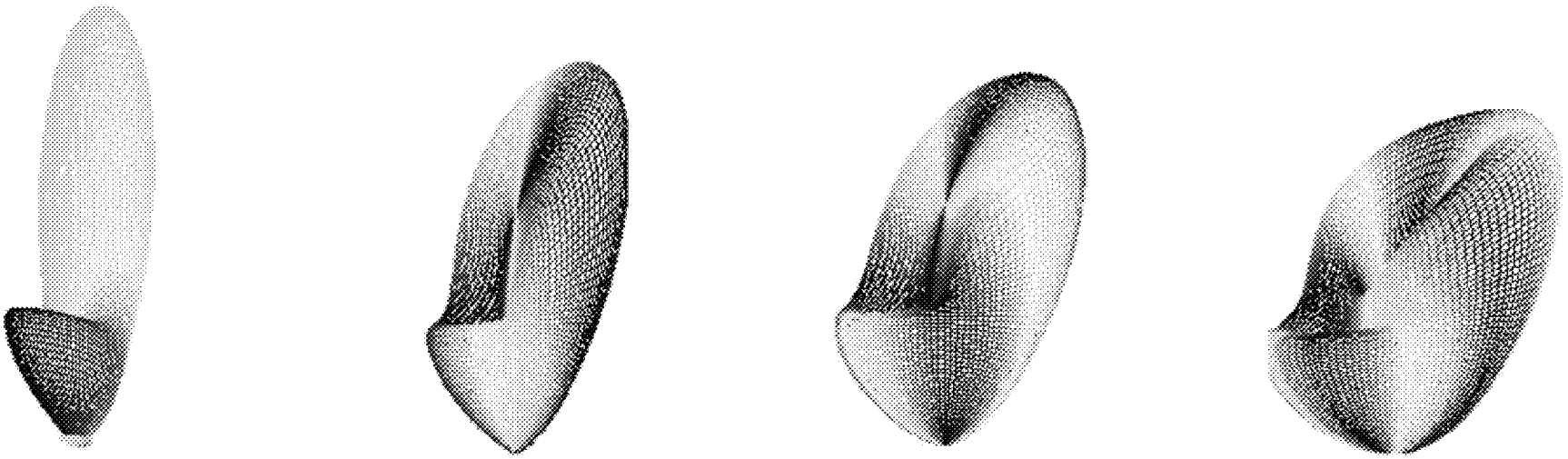
FIG. 10 shows simulations of the radiation pattern of an example main beam, in another example configuration of the stacked waveguide assembly.

FIG. 9 shows simulations of the radiation pattern of an example main beam M, in an example configuration of the waveguide assembly 130 and using the circuitry of FIG. 7, in which the higher-order phase mode (i.e., $P_{K+1}$) is from the lower radial TEM waveguide 106*b* and the lower-order phase mode (i.e., $P_K$) is from the upper radial TEM waveguide 106*a*, and where the difference in radii between the upper and lower radial TEM waveguides 106*a*, 106*b* is $\lambda/2$ and the radiating elements fed by both TEM waveguides 166 are in the same plane. The simulations in FIG. 9 were carried out for K=0, 1, 2 and 3 (shown left-to-right). FIG. 10 shows simulations of the radiation pattern of an example main beam, in another example configuration of the stacked waveguide assembly 130 and using the circuitry of FIG. 7. Similar to the simulations carried out for FIG. 9, in the simulations carried out for FIG. 10, the difference in radii between the upper and lower radial TEM waveguides 106*a*, 106*b* is $\lambda/2$ and K=0, 1, 2 and 3 (shown left-to-right). However, in the simulations of FIG. 10, the higher-order phase mode (i.e., $P_{K+1}$) is from the upper radial TEM waveguide 106*a* and the lower-order phase mode (i.e., $P_K$) is from the lower radial TEM waveguide 106*b*, and all the radiating elements of the concentric ring antenna array are in the same plane.

It can be seen that the radiation patterns in FIG. 9 has smaller side lobes than the radiation patterns in FIG. 10. On the other hand, the radiation patterns in FIG. 10 may provide finer control of radial tilt than the radiation patterns in FIG. 9. Thus, the appropriate configuration may be selected based on different applications.

Examples disclosed herein may enable greater tilt from the z-axis, compared to what is available with arrangements using only phase-modes corresponding to K=0, +1, −1, and may be useful particularly where limited 2D steering is desirable. Further, examples disclosed herein may enable reduction of feed losses and reduction in the number of phase-shifters used. For example, because a Butler matrix is not required, the feed network may be simplified. The number of phase-shifters needing to be controlled is a fixed small number independent of the number of radiating elements in the circular antenna array, unlike many conventional approaches.

The disclosed configurations may be implemented with the feed and antenna arrays integrated in a planar structure. An all-planar configuration may facilitate integration with an axially-radiating circular antenna array and two-axis phase-mode-enabled beam-steering subsystem.

The disclosed configurations enable any number of radiating elements to be fed, using a fixed number of phase shifters independent of the number of elements, thus enabling realization of a low cost, small size antenna.

Although examples provided herein show implementation for a planar circular antenna array, the teachings of this disclosure may be adapted to non-circular antenna arrays, including polygonal (e.g., square) antenna arrays. The teachings of this disclosure may be applicable to filled antenna arrays (e.g., radial slot arrays) as well as partially-filled antenna arrays. For polygonal antenna arrays, the variable phase shifter is again positioned in the annular region between the central coaxial phase-mode feed probes and the radiating element probes, and the phase shift progresses in a linear progression in a circumferential direction around the polygon. Although examples described herein show implementation for an antenna array having two concentric rings of radiating elements, there may be a greater number of rings of concentric elements. For example, one or both of the radial TEM waveguides may feed more than one ring of radiating elements.

Examples disclosed herein may be useful for microwave and/or millimeter wave (mmWave) antenna arrays, for example in small-cell, high-capacity networks, such as those found in dense urban environments. For example, electronic devices such as small-cell backhaul, mmWave peer-to-peer radio devices, or mobile satellite communications (satcom) terminals may benefit from the disclosed examples.

The present disclosure may be embodied in other specific forms without departing from the subject matter of the claims. The described example embodiments are to be considered in all respects as being only illustrative and not restrictive. Selected features from one or more of the above-described embodiments may be combined to create alternative embodiments not explicitly described, features suitable for such combinations being understood within the scope of this disclosure.

All values and sub-ranges within disclosed ranges are also disclosed. Also, although the systems, devices and processes disclosed and shown herein may comprise a specific number of elements/components, the systems, devices and assemblies could be modified to include additional or fewer of such elements/components. For example, although any of the elements/components disclosed may be referenced as being singular, the embodiments disclosed herein could be modified to include a plurality of such elements/components. The subject matter described herein intends to cover and embrace all suitable changes in technology.

The invention claimed is:

1. A feed network for a steerable antenna array, the feed network comprising:

a waveguide assembly including:

a first radial transverse electromagnetic (TEM) waveguide and a second radial TEM waveguide, the first and second radial TEM waveguides being stacked on each other, the first radial TEM waveguide including a first plurality of radiating element probes for coupling to a first ring of radiating elements of the antenna array and the second radial TEM waveguide including a second plurality of radiating element probes for coupling to a second ring of radiating elements of the antenna array;

a first variable phase shifter positioned in the first radial TEM waveguide, the first variable phase shifter being configured to cause additional progressive electrical phase shifts in the first ring of radiating elements, directly proportional to angular position of the radiating elements in the first ring, from 0 to an integer multiple of $2\pi$ radians, the integer multiple being controllable; and a second variable phase shifter positioned in the second radial TEM waveguide, the second variable phase shifter being configured to cause additional progressive electrical phase shifts in the second ring of radiating elements, directly proportional to angular position of the radiating elements in the second ring, from 0 to an integer multiple of $2\pi$ radians, the integer multiple being controllable; and first and second phase-mode feed probes coupled to the first and second radial TEM waveguides, respectively, the phase-mode feed probes providing respective phase-mode feed ports;

wherein, when the feed network is coupled to the antenna array, two consecutive-order phase modes are provided at the phase-mode feed ports, the orders of the phase modes being selectable in accordance with at least one phase shift control signal controlling the integer multiple of the first and second variable phase shifters.

2. The feed network of claim 1, wherein the waveguide assembly is configured for a concentric circular antenna array, the first radial TEM waveguide is configured to couple to an inner concentric ring of the antenna array and the second radial TEM waveguide is configured to coupled to an outer concentric ring of the antenna array, and wherein the first and second radial TEM waveguides are concentrically stacked on each other.

3. The feed network of claim 2, wherein a lower order of the consecutive-order phase modes is obtained from the first radial TEM waveguide, and a higher order of the consecutive-order phase modes is obtained from the second radial TEM waveguide.

4. The feed network of claim 2, wherein a higher order of the consecutive-order phase modes is obtained from the first radial TEM waveguide, and a lower order of the consecutive-order phase modes is obtained from the second radial TEM waveguide.

5. The feed network of claim 1, wherein the waveguide assembly is configured for a polygonal antenna array.

6. The feed network of claim 1, wherein the first and second phase-mode feed probes are coaxially arranged.

7. The feed network of claim 1, wherein the first and second variable phase shifters are liquid crystal analog phase shifters.

8. The feed network of claim 1, wherein separate first and second phase shift control signals are used to control the integer multiple of the first and second variable phase shifters, respectively; the first variable phase shifter being controlled to cause phase shifts in the first ring of radiating elements from 0 to $K2\pi$ radians, the second variable phase shifter being controlled to cause phase shifts in the second ring of radiating elements from 0 to $(K+1)\ 2\pi$ radians, K being an integer; and the phase modes provided at the phase-mode feed ports are K-th and K+1-th order phase modes.

9. The feed network of claim 1, further comprising a fixed spiral phase shifter in the first radial TEM waveguide, the fixed spiral phase shifter being configured to cause additional progressive electrical phase shifts in the first ring of the antenna array from 0 to 27 radians, wherein the first and second variable phase shifters are controlled by a common phase shift control signal.

10. The feed network of claim 1, wherein the waveguide assembly is configured for an antenna array having circularly polarized radiating elements, wherein the first and second variable phase shifters are controlled by a common phase shift control signal.

11. An apparatus for beam steering a steerable antenna array, the apparatus comprising:

the feed network of claim 1; and a beam steering circuitry coupled to the phase-mode feed ports of the feed network, the beam steering circuitry being configured to combine the two consecutive-order phase modes to generate a main beam of the steerable antenna array, the beam steering circuitry controlling the polar angle and azimuth angle of the main beam to direct the main beam in a selected direction.

12. The apparatus of claim 11, wherein the beam steering circuitry comprises a monitoring and control sub-circuit configured to monitor signal strength of at least one of the phase modes and provide feedback for the phase shift control signal.

13. A steerable antenna array system comprising:

a plurality of radiating elements arranged in a planar antenna array;

the feed network of claim 1; and a beam steering circuitry coupled to the phase-mode feed ports of the feed network, the beam steering circuitry being configured to combine the two consecutive-order phase modes to generate a main beam of the steerable antenna array, the beam steering circuitry controlling the polar angle and azimuth angle of the main beam to direct the main beam in a selected direction.

14. The system of claim 13, wherein the planar antenna array is a circular antenna array, and the radiating elements are arranged in concentric rings.

15. The system of claim 13, wherein the planar antenna array is a polygonal antenna array, and the radiating elements are arranged in concentric polygons.

* * * * *